US005372311A

United States Patent [19]

Nye

[11] Patent Number: 5,372,311

[45] Date of Patent: Dec. 13, 1994

[54] SPRAY TYPE PRESSURE DISPENSING CONTAINER

[76] Inventor: Norman H. Nye, 1348 High Bridge Rd., Cuyahoga Falls, Ohio 44223

[21] Appl. No.: 101,912

[22] Filed: Aug. 4, 1993

[51] Int. Cl.[5] ..... B05B 9/00

[52] U.S. Cl. ..... 239/320; 222/518; 239/478; 239/480; 239/483

[58] Field of Search ..... 222/518, 559; 239/478, 239/479, 480, 320, 483

[56] References Cited

U.S. PATENT DOCUMENTS

| | | | |
|---|---|---|---|
| 1,195,080 | 8/1916 | Petit | 239/483 X |
| 2,137,786 | 11/1938 | Schlosser | 239/480 X |
| 2,576,534 | 11/1951 | Paasche | 239/483 |
| 2,621,076 | 12/1952 | Barton | 239/480 X |
| 3,282,511 | 11/1966 | Barton | 239/480 X |
| 3,701,478 | 10/1972 | Tada | 239/333 |
| 3,967,765 | 7/1976 | Micallef | 239/478 X |
| 4,534,512 | 8/1985 | Chow et al. | 239/483 X |
| 4,706,888 | 11/1987 | Dobbs | 239/483 X |
| 4,890,792 | 1/1990 | Martin et al. | 239/478 X |
| 5,160,072 | 11/1992 | Nye | 222/463 |

*Primary Examiner*—Andres Kashnikow

*Assistant Examiner*—Joseph A. Kaufman

*Attorney, Agent, or Firm*—Oldham, Oldham & Wilson Co.

[57] ABSTRACT

A pressurized liquid dispensing container and valve assembly comprises an essentially upright container for containing under pressure a liquid to be dispensed and a discharge valve assembly above the container. The valve assembly includes a valve body and a nozzle having a discharge opening that is controlled by a valve. The valve includes a frustoconical valve seat formed in an end wall of the nozzle, and a frustoconical valve head which is axially movable between an inward seating position and an outward position in which the valve is open. A protective cap is screw threaded on the outside of the nozzle and has a discharge aperture in its outer end wall. The valve head has an outer end surface that normally abuts against an inside surface of the cap so as to restrict flow from the nozzle through the discharge aperture in the cap. The cap when screwed tightly holds the valve closed. Partial unscrewing of the cap adjusts the amount of valve opening and rate of liquid discharge. By partial unscrewing of the cap, one can obtain either a spray or a steady stream of liquid.

4 Claims, 2 Drawing Sheets

SPRAY TYPE PRESSURE DISPENSING CONTAINER

BRIEF SUMMARY OF THE INVENTION

This invention is for a container assembly that is to be used for dispensing liquids by pressure and particularly for low pressure spraying applications. It is safer to use than aerosol dispensing containers that use flammable hydrocarbon gas for a source of pressure and it requires less manual energy to operate than pump type dispensing containers, a particular advantage to older and arthritic persons. It is also of a very simple low cost design that is hand to use.

DETAILED DESCRIPTION

Figures 1, 2, 3, 4, 5:
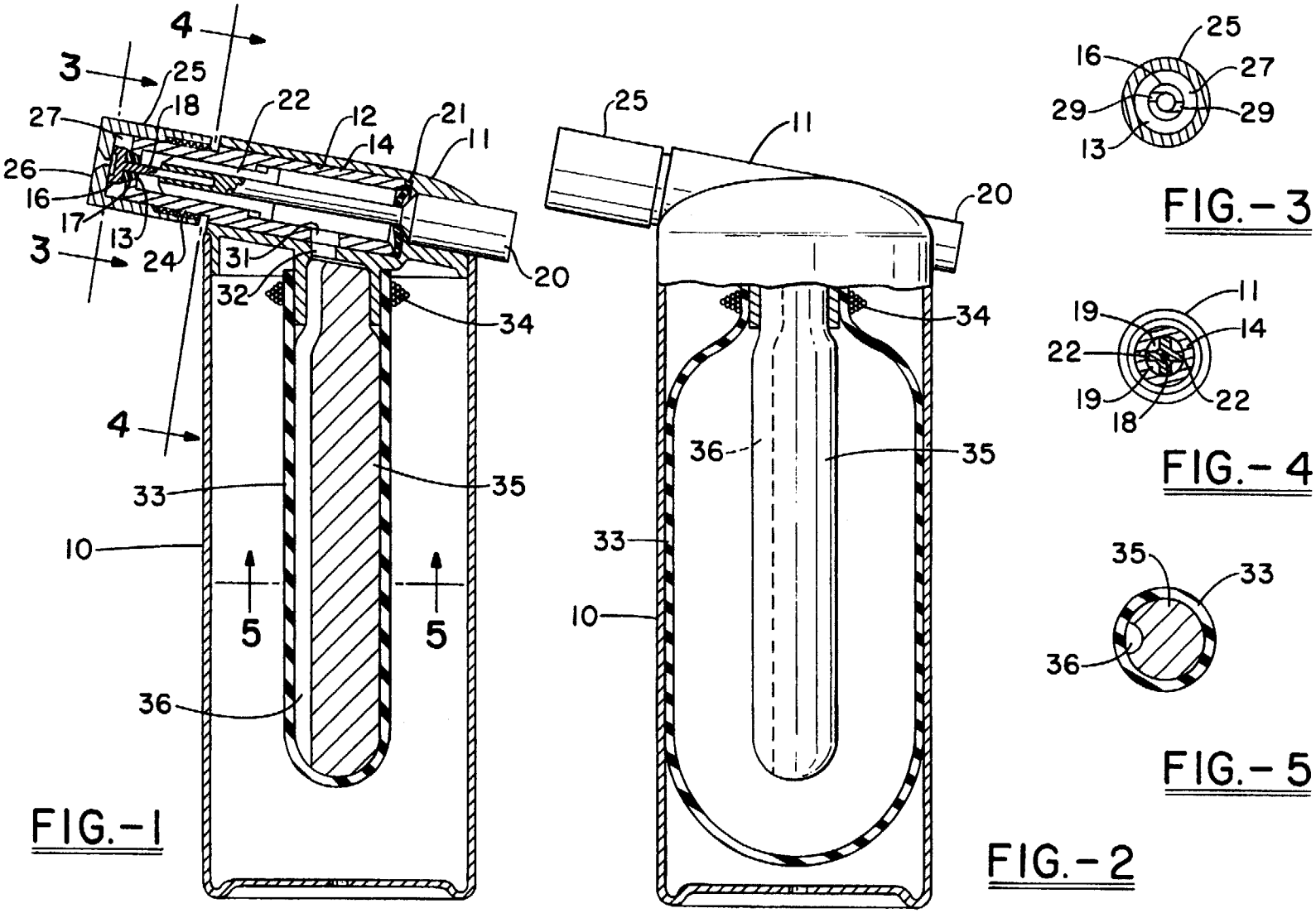
FIG. 1 illustrates a cross-section about normal size as the container is manufactured and before it is filled with a liquid.
FIG. 2 is a partial cross-section showing the inner pouch as it is distended when filled with a liquid.
FIG. 3 is a cross-section taken along line 3—3 of FIG. 1.
FIG. 4 is a cross-section taken along line 4—4 of FIG. 1.
FIG. 5 is a cross-section taken along line 5—5 of FIG. 1.

Referring to the drawings, the container is composed of an outer shell 10 to which is attached a valve body 11. A cylindrical bore 12 is provided in the valve body 11 that has an axis that is transverse to the axis of the housing 10.

There is a discharge nozzle 13 that is integral with a tubular sleeve 14 that is tightly pressed into the bore 12. A valve controls discharge of liquid through the tightly pressed into the bore 12. A valve controls discharge of liquid through the nozzle. Discharge nozzle 13 includes a hollow cylindrical barrel **13*a*. The outermost end of nozzle 13 is a flat wall 13*b* in which is formed a frustum shaped female valve seat 15. The largest diameter of the frustum shape is at the outermost end of the nozzle 13. A male valve assembly comprising a cylindrical head 16 comprising an annular forward portion that ends in an annular outer and surface 16*a* a soft frustum shaped ring 17, stems 18 and 19 and push button 20, is arranged for axial movement to cooperate with the female valve seat 15 to open and close the valve, which is formed by said valve seat 15 and male valve assembly 16. An elastic flexible diaphragm 21 is provided to prevent leakage around the push button 20. Stem 19 has integral vanes 22 (see FIG. 4) that maintain the male valve parts 16 and 17 central at all times. Vanes 22 have projections 23 that act as stops to limit the travel of the male valve assembly. The elastic flexible diaphragm 21 is flexed some, even when the valve is closed so as to provide force that together with the pressure of the liquid in the container will normally keep the valve closed. The barrel 13*a* of nozzle 13 is threaded at 24**.

A cap 25 having internal screw threads is provided so that when the cap 25 is in place and tightened against the cylindrical head 16 of the male valve the valve cannot be opened. The cap 25 has in its outer end a discharge aperture or hole 26. Inside cap 25 and downstream of valve seat 15 is a chamber 27 which is defined by cap 25 and forward wall **13*b* of nozzle 13. In the outer surface of male valve head 16 is a recess 28 which is formed by a forwardly projecting annular portion 16*a* of valve head 16. Ducts 29—29 (see FIG. 3) which preferably are arranged tangentially as shown, provide communication between chamber 27 and recess (or chamber) 28, so that as liquid passes from chamber 27 through ducts 29—29 into recess 28 and out through the discharge aperture 26, there will be a swirling action in the liquid that helps to spread the spray shape of the discharged liquid. The nozzle 13 is made of a plastic that has resiliency and has a groove 30 recessed in the outer end of it in such a manner that a cup style seal is constructed that hugs the inside bore of cap 25 and provides a seal to prevent leakage between the cap 25 and the nozzle 13. The tubular sleeve 14 has an opening 31 that matches an opening 32 in valve body 11**.

An elastic pouch 33 is provided to receive and contain the liquid that is to be dispensed. The pouch 33 can be made of an elastic plastic such as polyurethane or of various rubber compounds such as nitrile or it can be made of an inelastic plastic that has been pleated and is encased in a rubber sleeve. The pouch 33 can be tightly secured to the valve body 11 by being tightly wound with several turns of tensilized rubber thread 34. Such rubber thread is readily available as it is used in making golf balls. A space take up piece 35 may be provided to facilitate the dispensing of nearly all of the liquid and is made of closed cell foamed rigid plastic or other light and low cost material. A groove 36 is formed in this take up piece 35 (see FIG. 5) to enhance the flow of liquid when the container is nearly empty.

Figure 6:
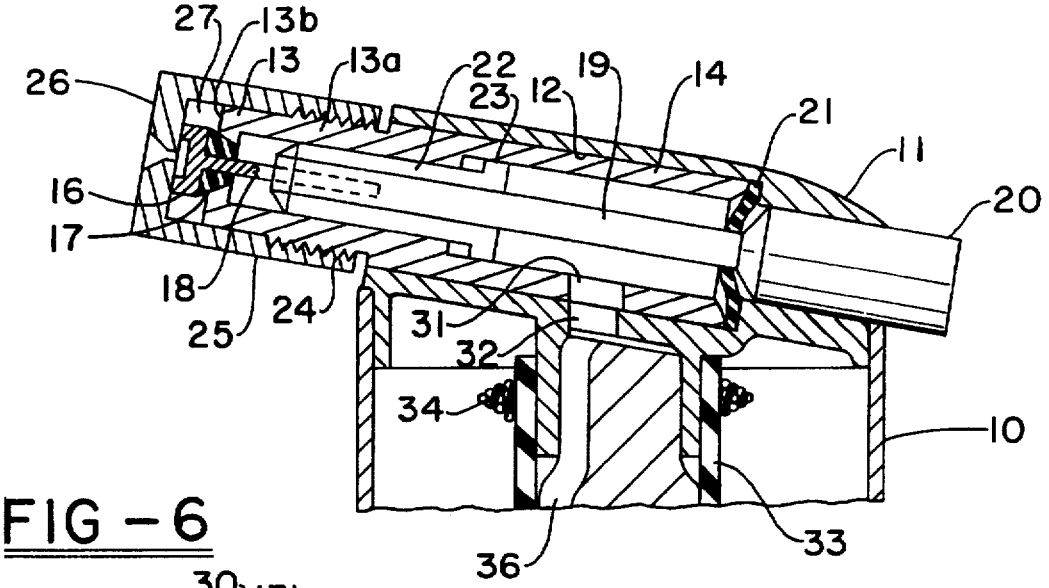
FIG. 6 is a cross-section of the valve part of the container as shown on FIG. 1 except that it is enlarged to bring out liner details of its construction. This view shows the valve as being closed.

The operation of the dispensing container will now be described, assuming that the container has been filled with liquid and the valve is closed as shown in FIG. 6. This shows a first position of cap 25. In this position the cap 25 is screwed tight and the outer (or forward) end surface **16*a* of valve member 16 abuts against the inside surface of cap 25**. Then the valve cannot be opened even if the push button is inadvertently pressed.

Figure 7:
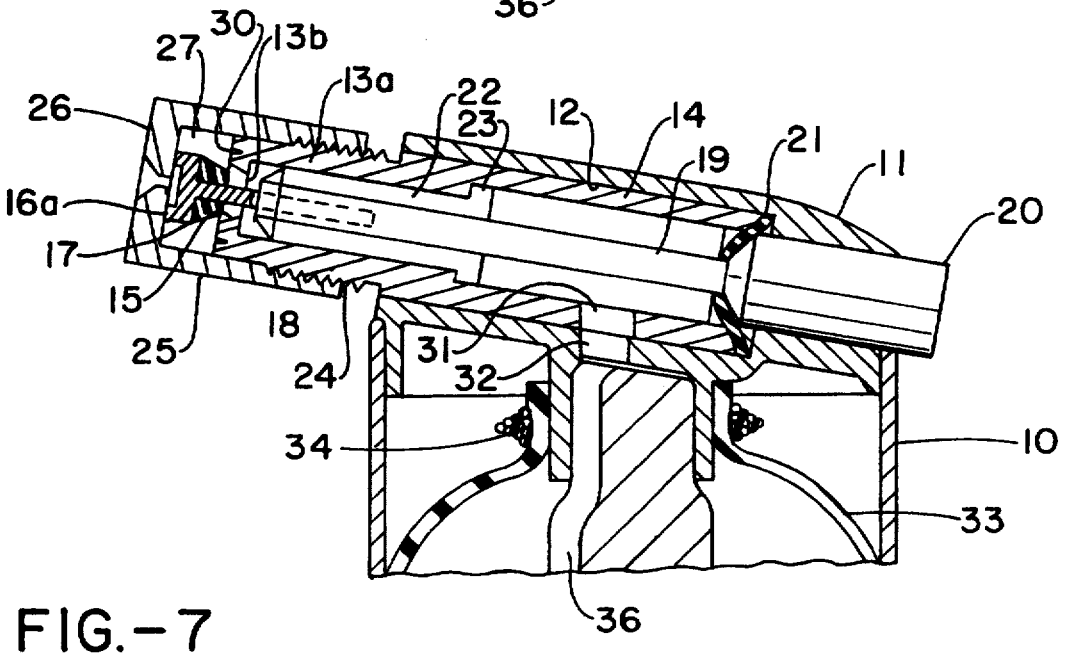
FIG. 7 is the same as FIG. 6. except that the valve is shown open.

When the cap 25 is unscrewed slightly then a fine spray will take place if the push button is pressed. If the cap is further unscrewed to the stop position shown in FIG. 7 (a second position of cap 25) then the maximum spray action will be obtained. When the cap is in this position, the valve (15, 16) is open but the annular forward end **16*a* of valve head is still in contact with the inside of cap 25, so that ducts 29—29 provide the sole communication between chamber 27 and recess 28**.

Figure 8:
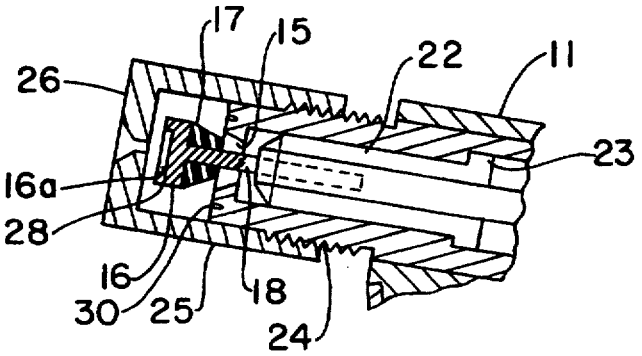
FIG. 8 is a partial cross-sectional view similar to FIG. 6 except that the device is shown in still another operative position permitting increased liquid flow.

Further unscrewing of the cap 25 to a third position as shown on FIG. 8 may produce greater flow of liquid but it will then come out in a solid stream. When the cap is in the position shown in FIG. 8, liquid flows both through and around ducts 29—29 from chamber 27 discharge opening 26, resulting in a solid stream. The cap is axially movable between the positions described. The cap should never be removed entirely.

What is claimed is:

1. A spray type pressure dispensing container comprising (a) a container having a nozzle attached and connected thereto for directing discharge of fluid from said container;

(b) passage ways for conducting liquid to a valve from the said container;

(c) said nozzle comprising a hollow cylindrical barrel having an externally threaded portion and further comprising an end wall that contains a frustoconical female valve seat;

(d) a male valve assembly that comprises a male valve member having an outer end surface and a frustoconical surface which matches the shape of the female valve surface, a valve stem, a push button, and a flexible stretched diaphragm all arranged for axial movement to open and close a valve; said valve being formed by said valve seat and said male valve member;

(e) a cap that is threaded internally to screw into the said nozzle and has an end wall containing a discharge aperture and an inside surface of the end wall that abuts against said outer end surface of the said male valve member for spray adjustment and for preventing leakage and opening of the valve when the said cap is screwed tight; and (f) a stop that limits the axial travel of the said valve assembly when the said cap is unscrewed;

said cap and the end wall of said nozzle forming a chamber for liquid, downstream of said nozzle;

said outer end surface of said male valve member being shaped so as to form with said cap a recess that is in communication with said discharge aperture;

ducts extending through said male valve member and providing communication between said chamber and said recess;

said cap being axially movable between a first position in which said valve is closed, a second position in which said valve is open and the outer surface of said male valve member abuts against the inside surface of said protective cap so that liquid is discharged as a spray, and a third position in which said male valve member is spaced from the inside surface of said cap so that liquid is discharged as a stream.

2. A dispensing container as claimed in claim 1 in which said male valve member has a forwardly projecting annular portion and said ducts extend tangentially through said forwardly projecting annular portion.

3. A pressurized liquid dispensing container and valve assembly comprising (a) an essentially upright container for containing under pressure a liquid to be dispensed, said container having an upper end and an essentially vertical central axis (b) a discharge valve assembly above the upper end of said container for controlling the discharge of said liquid from said container, said valve assembly comprising (1) an essentially cylindrical hollow valve body having a central bore and central axis which is transverse to the central axis of said container, said valve body having first and second ends and an opening between said ends which provides communication between said container and the bore of said valve body;

(2) a discharge nozzle at said first end of said valve body, said discharge nozzle including an outer surface and a valve, said valve having a frustoconical valve seat surrounding a discharge opening, said frustoconical valve seat having an inlet end and an outlet end, the outlet end being of larger diameter than the inlet end;

(3) a frustoconical valve head for seating on said valve seat and an essentially cylindrical valve stem connected to said valve head, the valve head being of frustoconical shape to correspond to and fit the valve seat, said valve stem being disposed inside said valve body and extending longitudinally along the axis of said valve body, said valve head and valve stem being axially movable between an inward seating position and an outward position in which said valve is open so as to permit discharge from said container;

(4) a push button attached to said valve stem at the first end of said valve body for moving said valve head to open position;

(5) a diaphragm for sealing against leakage around the said push button and by being stretched and exposed to liquid pressure it biases the valve head and valve stem toward sealing position;

(6) stop means for limiting the travel of the said valve head and valve stem when the valve is opened; and (c) a protective cap that is screw threaded on the outside of said nozzle and that has a discharge aperture in its outer end wall, the inner surface of the said end wall abuts against the said valve head for holding the valve closed when the said protective cap is screwed tight and for adjusting the amount of valve opening when said protective cap is partly unscrewed.

4. A dispensing container and valve assembly as claimed in claim 3 wherein said cap axially movable between a first position in which said valve is closed, a second position in which said valve is closed, a second position in which flow of liquid is restricted and a spray results and a third position in which greater liquid flow results.

* * * * *